United States Patent [19]

Nielsen

[11] 4,406,652

[45] Sep. 27, 1983

[54] CENTRIFUGE WITH A SKIMMER DISC FOR DISCHARGING A LIQUID PHASE

[75] Inventor: Helmut K. Nielsen, Slangerup, Denmark

[73] Assignee: Alfa-Laval Separation A/S, Denmark

[21] Appl. No.: 385,088

[22] Filed: Jun. 4, 1982

[30] Foreign Application Priority Data

Jun. 30, 1981 [DK] Denmark ..... 2909/81

[51] Int. Cl.[3] ..... B04B 1/00; B04B 11/08

[52] U.S. Cl. ..... 494/56; 494/43

[58] Field of Search ..... 494/43, 56, 57, 58, 494/59

[56] References Cited

U.S. PATENT DOCUMENTS 2,171,136 8/1939 Bergner ..... 494/43 X
3,968,929 7/1976 Olesen .
3,971,509 7/1976 Johnsen .

FOREIGN PATENT DOCUMENTS 63738 7/1945 Denmark .

*Primary Examiner*—Robert W. Jenkins
*Assistant Examiner*—Arthur D. Dahlberg
*Attorney, Agent, or Firm*—Bernard, Rothwell & Brown

[57] ABSTRACT

In a stationary skimmer disc for withdrawing a liquid phase from a centrifuge there are formed one or more liquid discharge ducts each having an inlet at the outer periphery of the disc and at least one outlet located closer to the center of the disc. From a region of the flow path of the discharged liquid, where the static liquid pressure, during operation of the centrifuge, exceeds the static pressure at the inlet to the discharge duct or ducts, a by-pass duct having a throttling means intermediate its ends leads back to each of said inlets.

9 Claims, 6 Drawing Figures

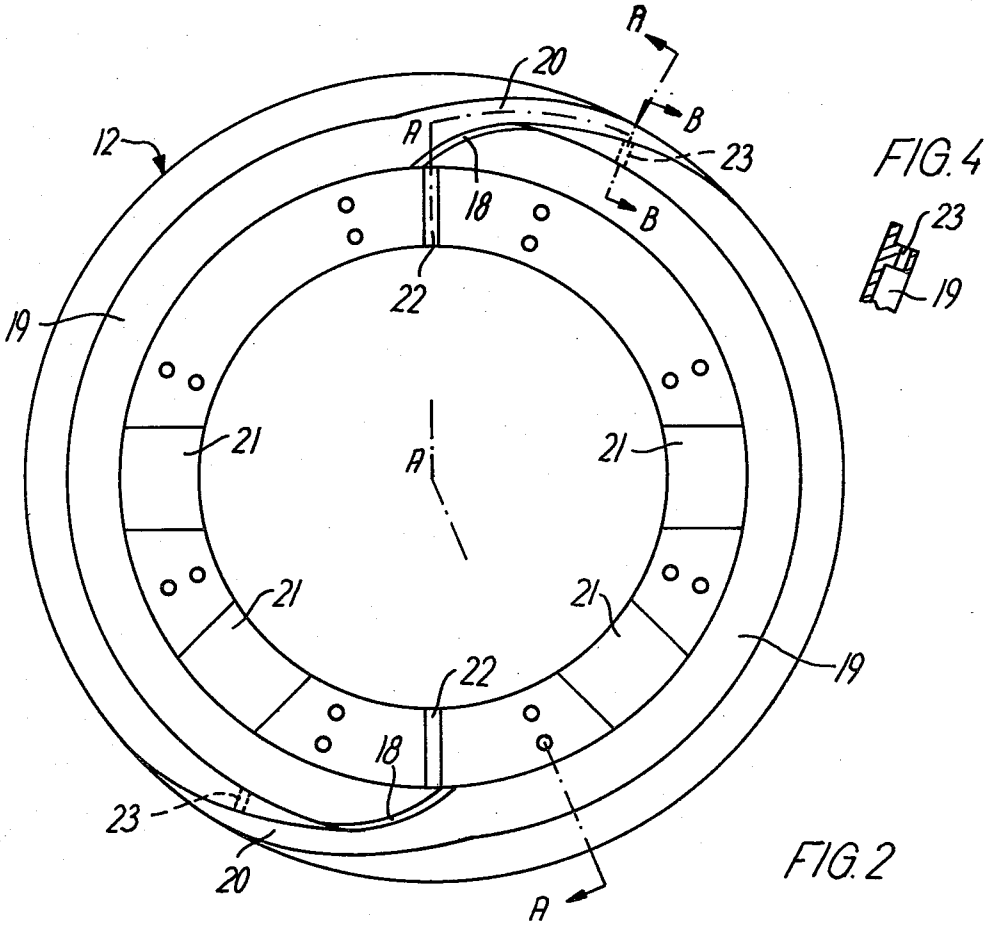
FIG. 2
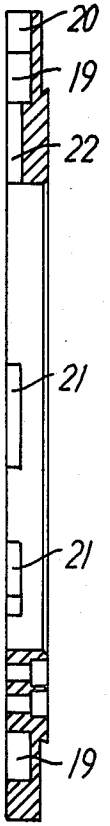
FIG. 3
FIG. 4

CENTRIFUGE WITH A SKIMMER DISC FOR DISCHARGING A LIQUID PHASE

BACKGROUND OF THE INVENTION

This invention relates to a centrifuge for separating a mixture containing at least one liquid phase, comprising a rotary drum or bowl and a stationary, annular skimmer disc for discharging the liquid phase through at least one discharge duct in the skimmer disc, said discharge duct having a substantially tangential inlet at the outer periphery of the disc and an outlet located closer to the centre of the disc.

In centrifuges of this kind there may sometimes occur rather large amounts of gas in the liquid phase withdrawn through the skimmer disc, and an object of the present invention is to remedy this disadvantage.

SUMMARY OF THE INVENTION

According to the present invention a centrifuge of the kind referred to above is characterized in that a by-pass duct issues from a region of the flow path of the liquid phase where the static liquid pressure, during operation, is higher than at the inlet of the discharge duct, and which opens into the outer periphery of the skimmer disc in the region of said inlet, and in that a throttling means is provided in said by-pass duct intermediate its ends.

It has been found that with a skimmer disc according to the invention it is possible to reduce the content of gas in the withdrawn liquid phase to about 3 ppm. and it has, furthermore, been found that this favourable effect can be obtained even when the capacity of the centrifuge, i.e. the flow rate of the discharged liquid phase, varies within a rather wide range. It is believed that the effect can be ascribed to the fact that through the by-pass duct a certain, relatively small amount of liquid flows back to the inlet area of the discharge duct where the static liquid pressure is relatively low due to the fast spinning liquid ring, and that this backflow of liquid affects the inflow conditions at the inlet in such a way that the undesired drawing-in or entrainment of gas is substantially reduced. In a concrete case it was found that the provision of the by-pass duct made it possible to obtain satisfactory values of the gas content within a capacity range in which the ratio of maximum to minimum capacity was about 3.5 whereas the corresponding ratio was at most 1.2 with the same skimmer disc without a by-pass duct. The liquid backflow has also been found to reduce the risk of cavitation in the liquid flow resulting from a low static liquid pressure, and the concomitant erosion attacks on the surfaces of the duct inlet.

An optimum effect of the backflow through the by-pass duct seems to be obtained when the opening of the by-pass duct is located closely behind the leading edge of the inlet, as seen in the direction of rotation of the drum, in which case the backflowing liquid issues as a jet directed across the inlet area.

The throttling means may be located at the opening of the by-pass duct which may be provided by a drilled hole, since it is then easy to change the cross sectional area of the opening if this proves to be desirable after commissioning of the centrifuge, either by drilling a larger diameter hole or by inserting a plug with a narrower hole.

The by-pass duct may issue from an annular duct forming part of the liquid flow path downstream of the outlet of the discharge duct.

Alternatively, when there are at least two discharge ducts in the skimmer disc, a by-pass duct may issue from a stagnation zone of each discharge duct and open at the inlet to a different discharge duct.

Said stagnation zone, from which each by-pass duct issues, may be formed by the closed end of a side branch of a discharge duct.

In a further embodiment each discharge duct is provided with a plurality of outlets spaced longitudinally of the duct, and the by-pass duct issues from a location between the last two outlets, as seen in the liquid flow direction.

In this embodiment the last outlet from each discharge duct may be narrower that any of the other outlets from that discharge duct.

BRIEF DESCRIPTION OF THE DRAWINGS

The invention will be described in more detail below with reference to the partly schematical drawings, in which FIG. 2 is a plan view of the skimmer disc of the centrifuge, FIG. 3 is a section along the broken line A—A of FIG. 2, FIG. 4 is a section along line B—B of FIG. 2.

DETAILED DESCRIPTION

Figure 1:
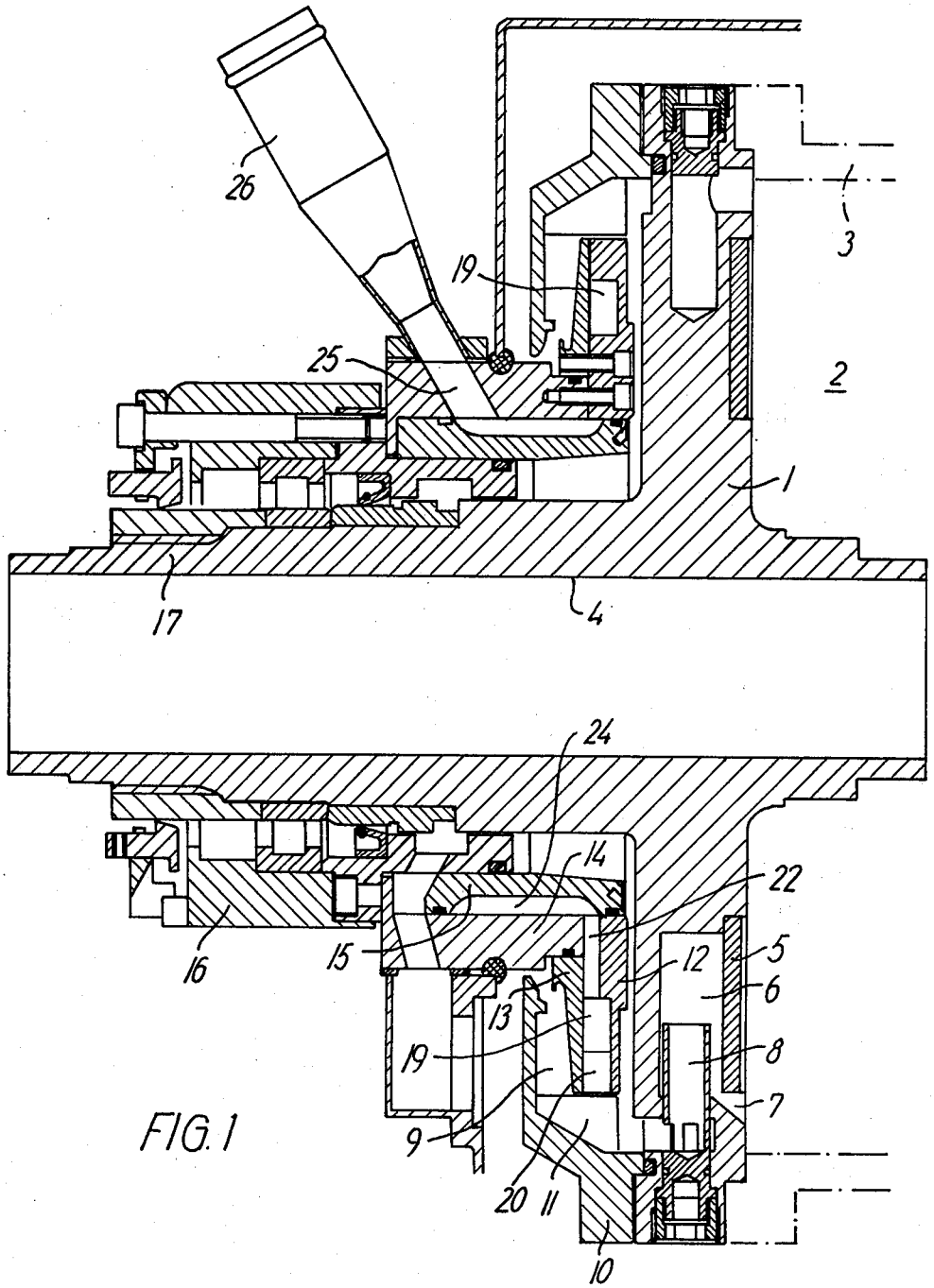
FIG. 1 is a longitudinal section through one end of a centrifuge embodying the invention and constructed as a decanter centrifuge with horizontal axis.

FIG. 1 shows, by and large, only those components of the centrifuge which are necessary for the understanding of the invention, more specifically one end wall 1 of the separating space 2 of the centrifuge and those components located outside end wall 1 which serve for discharging a liquid phase from the separating space. The centrifuge further comprises a non-apertured drum 3 secured to end wall 1 and indicated in FIG. 1 by dot-and-dash lines, and a conveyor screw (not shown) which is coaxial with drum 3 and journalled at its ends in end wall 1 and in the opposed end wall (not shown), respectively. The shaft of the screw extends from the drum through a central bore 4 in the end wall and by means of an external gear (not shown) it is coupled to the end wall and, hence, to the drum in such a manner that it rotates in the same direction as the drum but with a slightly different rpm. The screw thus serves for conveying a solids phase which in separating space 2 is separated from a raw material supplied to the drum, towards a solids outlet at the opposite end (not shown) of the drum. As for further details of the structure and the functioning of the decanter centrifuge, reference is made to U.S. Pat. Nos. 3,971,509 and 3,968,929 which are herewith incorporated by reference. U.S. Pat. No. 3,968,929 generally shows the discharge of a liquid phase from the separating space through a stationary skimmer disc.

Similar to what is disclosed in said U.S. Pat. No. 3,968,929 an annular disc 5 is mounted in an annular recess in that surface of end wall 1 which faces the separating space 2, and behind the recess a plurality of chambers or pockets 6 are formed in the end wall. Through cut-outs 7 in the outer periphery of the recess the pockets communicate with separating space 2. Said liquid phase can, therefore, flow from separating space 2 into pockets 6 and from there it can flow through bushings 8 inserted in the periphery of end wall 1 to a discharge chamber 9 defined between the outer side of end wall 1 and a cover 10 secured thereto. Vanes 11 on the inner side of the cover assist in maintaining the rotation of the liquid which flows into chamber 9.

An annular, stationary skimmer disc 12, which is shown in more detail in FIGS. 2–4, is mounted in chamber 9 with its outer periphery closely spaced from vanes 11, and to the side of disc 12 remote from end wall 1 there is secured a cover disc 13 and a sleeve 14, which surrounds, and is secured to, an intermediate sleeve 15. Sleeve 15 is secured to a bearing bracket 16 in which also the protruding boss 17 of end wall 1 is journalled.

As shown in FIGS. 2 and 3 there is a groove in the surface of skimmer disc 12 remote from end wall 1. The groove is concentric with the disc, and by means of two partitions 18 welded in place the groove is divided into two separate arcuate flow ducts 19 through which the liquid is discharged from chamber 9. Immediately adjacent one partition 18 each duct communicates with chamber 9 through an arcuate inlet 20 milled into the surface of the disc and formed such that its lateral faces merge substantially smoothly into the periphery of the disc. As seen in FIG. 3 the bottom of inlet 20 is flush with the bottom of duct 19.

From each duct 19 issue three radial outlets opening into the inner periphery of the disc, and two of the outlets, designated by 21 and spaced from one another between the ends of duct 19, are substantially wider than the third outlet 22 which is located at the closed end of the duct immediately adjacent partition 18. As seen in FIG. 3 the depth of the outlets, which like inlets 20 are formed by milling, is somewhat less than the depth of the inlets. In the embodiment shown their total sectional flow area is about 2.5 times the cross sectional area of duct 19, which in turn is about 3 times the cross sectional area of inlet 20 at the periphery.

Close to the closed end of each discharge duct 19 a hole 23 is drilled through the outer wall of the duct, and the outer opening of the hole is located just behind the leading edge, as seen the flow direction of the liquid (counterclockwise in FIG. 2), of inlet 20. Because the hole issues from duct 19 downstream of the last of the wide outlets 21, the velocity of the liquid flow at this place is low and its static pressure is, therefore, high relative to the static pressure in inlet 20. This differential pressure creates an outflow of liquid in the form of a relatively strong jet across the liquid entering through the inlet, and as mentioned above this has been found to result in a substantial reduction of the undesired entrainment of gas in the inflowing liquid, especially at relatively low inflow velocities corresponding to the centrifuge operating with a liquid discharge rate in the lower part of its capacity range.

The discharge ducts in the skimmer disc could be formed by milling rather than by a turning operation, which inter alia would eliminate the need for inserting partitions at the closed ends of the ducts. In that case the ducts need not be concentric with the skimmer disc, and they need not have a constant cross sectional area throughout their length. The drilled holes 23 could be replaced by milled grooves.

As seen in FIG. 1 the liquid flows from outlets 21 and 22 in the skimmer disc into an annular duct 24 in the surface of intermediate sleeve 15 and from that duct the liquid flows out through an inclined bore 25 in sleeve 14 and an upwardly directed discharge spout 26 connected thereto.

With this arrangement of the discharge spout the skimmer disc 12 shown is preferably mounted such that the two inlets 20 are located at the top and bottom, respectively, i.e. that the outlets 21 and 22 from the two ducts 19 are located symmetrically about a vertical plane through the axis of the centrifuge.

Figure 5:
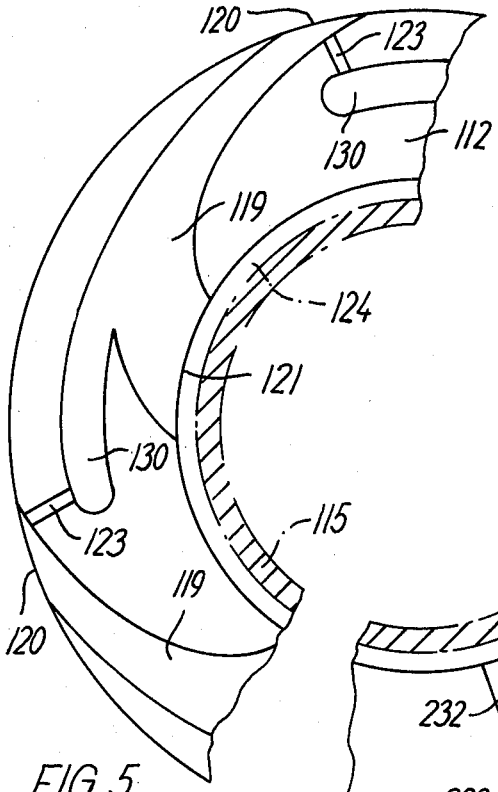
FIG. 5 is a fractional plan view of a modified skimmer disc.

The modified skimmer disc 112 illustrated in FIG. 5 may be combined with a cover disc similar to disc 13 and with further components as those shown in FIG. 1, which provide the flow path for the liquid withdrawn through the skimmer disc. An intermediate sleeve 115 and an annular duct 124 corresponding to items 15 and 24, respectively, of FIG. 1 have been shown in dot-and-dash lines. The surface of disc 112 seen in FIG. 5 is formed with a total number of four milled discharge ducts 119 each having an inlet 120 at the outer periphery of the disc and a single outlet 121 in the inner disc periphery. The longitudinal axis of each duct 119 is continuously curved, and the cross sectional area of the duct increases steadily from the inlet to the outlet. Intermediate the ends of each duct 119 a side branch 130 issues from the radially outer side of the duct and a relatively narrow groove 123 milled into the surface of disc 112 issues adjacent the closed end of side branch 130 and opens into the inlet 120 of the following discharge duct. The function of groove 123 is the same as that of hole 23, as described above.

Figure 6:
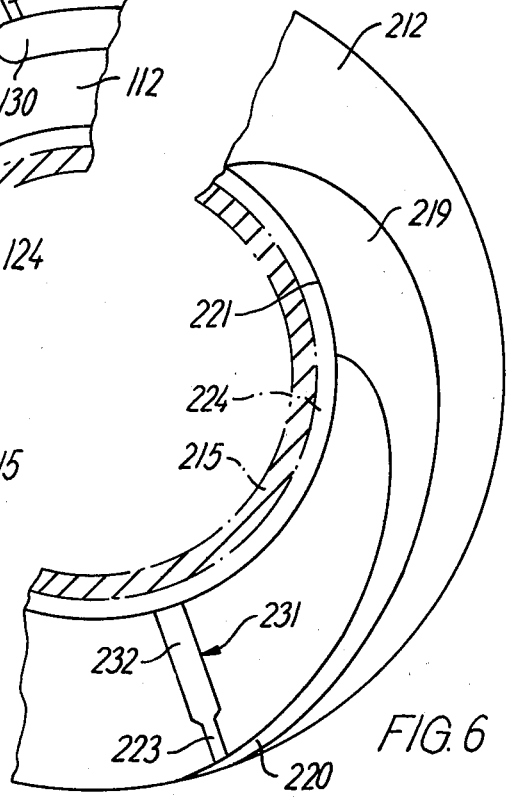
FIG. 6 is a similar fractional plan view of a further modified skimmer disc.

In the skimmer disc 212 illustrated in FIG. 6 there are a smaller number of discharge ducts 219, each of which is correspondingly longer than ducts 119 but otherwise of similar shape, including an inlet 220 and an outlet 221. In FIG. 6 the backflow of liquid to the inlets 220 of ducts 219 occurs through a corresponding number of by-pass ducts 231 milled into the surface of disc 212, and each duct 231 comprises a relatively wider inlet section 232 issuing from the annular duct 224, which corresponds to duct 24 of FIG. 1, and a narrower outlet section 223 opening into the inlet 220 and having the same function as described above for hole 23 and groove 123. In either embodiment the cross sectional area of the throttling means formed by holes 23 or grooves 123 or 223 may be between 15% and 40% of the cross sectional area of the inlet to the discharge duct.

It should be noted that the outlet or outlets of the discharge ducts in the skimmer disc could be directed parallel to the axis of the centrifuge rather than radially or substantially radially, as shown.

I claim:

1. In a centrifuge for separating a mixture containing at least one liquid phase, comprising a rotary drum and a stationary, annular skimmer disc for discharging the liquid phase through at least one discharge duct in the skimmer disc, said discharge duct having a substantially tangential inlet at the outer periphery of the disc and an outlet located closer to the centre of the disc, the improvement comprising a by-pass duct issuing from a region of the flow path of the liquid phase where the static liquid pressure, during operation, is higher than at the inlet of the discharge duct and opening into the outer periphery of the skimmer disc in the region of said inlet, and a throttling means provided in said by-pass duct intermediate its ends.

2. A centrifuge as claimed in claim 1, wherein the opening of the by-pass duct is located closely behind the leading end of the inlet as seen in the direction of rotation of the drum.

3. A centrifuge as claimed in claim 1, wherein the throttling means is located at the opening of the by-pass duct.

4. A centrifuge as claimed in claim 3, wherein the throttling means is a drilled hole.

5. A centrifuge as claimed in claim 1, wherein the by-pass duct issues from an annular duct forming part of the liquid flow path downstream of the outlet of the discharge duct.

6. A centrifuge as claimed in claim 1 and comprising at least two discharge ducts in the skimmer disc, wherein a by-pass duct issues from a stagnation zone of each discharge duct and opens at the inlet to a different discharge duct.

7. A centrifuge as claimed in claim 6, wherein each by-pass duct issues from the closed end of a side branch of a discharge duct.

8. A centrifuge as claimed in claim 6, wherein each discharge duct is provided with a plurality of outlets spaced longitudinally of the duct, and a by-pass duct issues from a location between the last two outlets of each discharge duct, as seen in the liquid flow direction.

9. A centrifuge as claimed in claim 8, wherein the last outlet from each discharge duct is narrower than any of the other outlets from that discharge duct.

* * * * *